US008743015B1

(12) United States Patent
West et al.

(10) Patent No.: US 8,743,015 B1
(45) Date of Patent: Jun. 3, 2014

(54) OMNI-DIRECTIONAL ULTRA WIDE BAND MINIATURE DOUBLY CURVED ANTENNA ARRAY

(75) Inventors: James B. West, Cedar Rapids, IA (US); Jonathan P. Doane, Cedar Rapids, IA (US); Wajih A. ElSallal, Cedar Rapids, IA (US); Lee M. Paulsen, Cedar Rapids, IA (US); Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 280 days.

(21) Appl. No.: 12/893,833

(22) Filed: Sep. 29, 2010

(51) Int. Cl.
*H01Q 1/12* (2006.01)

(52) U.S. Cl.
USPC ..... 343/878; 343/879; 343/853; 343/872

(58) Field of Classification Search
CPC ..... H01Q 1/12; H01Q 1/242; H01Q 1/246; H01Q 1/125; H01Q 1/42
See application file for complete search history.

(56) References Cited

U.S. PATENT DOCUMENTS

| | | | | |
|---|---|---|---|---|
| 4,380,012 | A * | 4/1983 | Bevan et al. | 343/705 |
| 5,017,925 | A * | 5/1991 | Bertiger et al. | 342/352 |
| 5,038,149 | A * | 8/1991 | Aubry et al. | 342/372 |
| 6,292,134 | B1 * | 9/2001 | Bondyopadhyay | 342/374 |
| 7,446,714 | B2 * | 11/2008 | Biddulph | 343/702 |
| 8,456,374 | B1 * | 6/2013 | Bagley et al. | 343/810 |
| 2002/0113742 | A1 * | 8/2002 | Bruzzone et al. | 343/757 |
| 2007/0057845 | A1 * | 3/2007 | Miura | 343/700 MS |
| 2007/0139291 | A1 * | 6/2007 | Sabet et al. | 343/872 |
| 2007/0216596 | A1 * | 9/2007 | Lewis et al. | 343/848 |
| 2008/0211726 | A1 * | 9/2008 | Elsallal et al. | 343/770 |
| 2009/0096691 | A1 * | 4/2009 | Apostolos | 343/742 |
| 2010/0079347 | A1 * | 4/2010 | Hayes et al. | 343/705 |
| 2011/0006957 | A1 * | 1/2011 | Scire-Scappuzzo et al. | 343/705 |
| 2011/0304974 | A1 * | 12/2011 | Knopf et al. | 361/679.34 |

OTHER PUBLICATIONS

N. Schuneman, J. Irion and R. Hodges, "Decade Bandwidth Tapered Notch Antenna Array Element," Proceedings of the 2001 Antenna Applications Symposium—vol. II, Sep. 19-21, 2001; pp. 280-294; Monticello, IL; 17 pages.

M. Stasiowski and D. H. Schaubert, "Broadband Phased Array," 2008 Antenna Applications Symposium, Sep. 16-18, 2008; pp. 17-41; Monticello, IL; 18 pages.

(Continued)

*Primary Examiner* — Trinh Dinh
(74) *Attorney, Agent, or Firm* — Donna P. Suchy; Daniel M. Barbieri

(57) ABSTRACT

A device occupying a volumetric space definable within the bounds of a substantially spherical volume for realizing isotropic radiation may include a support for supporting a plurality of multi-polarization capable antenna elements. The plurality of antenna elements may include a first antenna element oriented in a first direction, a second antenna element oriented in a second direction, and a third antenna element oriented in a third direction. The support may support the first antenna element, the second antenna element, and the third antenna element in an arrangement such that the second direction is at least substantially different than the first direction, and the third direction is at least substantially different than the first direction and the second direction. The plurality of antenna elements generally occupies a volumetric space definable within the bounds of a substantially spherical volume.

20 Claims, 13 Drawing Sheets

(56) References Cited

OTHER PUBLICATIONS

D. H. Schaubert, A.O. Boryssenko, M.N. Vouvakis, G. Paraschos, W. Elsallal and S. Kasturi, "Wide Bandwidth Arrays of Vivaldi Antennas," Organized by the Institution of Engineering and Technology Antennas and Propagation Network; Copyright the IET; 2008 Institution of Engineering and Technology Seminar on Wideband, Multiband Antennas and Arrays for Defence or Civil Applications; 21 pages.

J. J. Lee and S. Livingston, "Wide Band Bunny-Ear Radiating Element," Copyright 1993 IEEE; Antennas and Propagation Society International Symposium, Jun. 28-Jul. 2, 1993; pp. 1604-1607 vol. 3; 5 pages.

J. J. Lee, S. Livingston, and R. Koenig, "Performance of a Wideband (3-14 GHz) Dual-pol Array," Copyright 2004 IEEE; Antennas Propagation Society International Symposium, Jun. 20-25, 2004; pp. 551-554 vol. 1; 5 pages.

B. Munk, R. Taylor, T. Durham, W. Croswell, B. Pigon, R. Boozer, S. Brown, M. Jones, J. Pryor, S. Ortiz, J. Rawnick, K. Krebs, M. Vanstrum, G. Gothard and D. Wiebelt, "A Low-Profile Broadband Phased Array Antenna," Copyright 2003 IEEE; Antennas and Propagation Society International Symposium, Jun. 22-27, 2003; pp. 448-451 vol. 2; 5 pages.

P. Friederich, L. Pringle, L. Fountain, P. Harms, D. Denison, E. Kuster, S. Blalock, G. Smith, J. Maloney and M. Kesler, "A New Class of Broadband Planar Apertures," Proceedings of the 2001 Antenna Applications Symposium—vol. II, Sep. 19-21, 2001; pp. 561-587; Monticello, IL; 29 pages.

B. Thors, and H. Steyskal, "Synthesis of Planar Broadband Phased Array Elements with a Genetic Algorithm," Proceedings of the 2005 Antenna Applications Symposium, Sep. 21-23, 2005; pp. 324-344; Monticello, IL; 22 pages.

W.R. Pickles, J.B.L. Rao, D.P. Patel, and R. Mital, "Coincident Phase Center Ultra Wideband Array of Dual Polarized Flared Notch Elements" Copyright 2007 IEEE; Antennas and Propagation Society International Symposium, Jun. 9-15, 2007; pp. 4421-4424; 5 pages.

* cited by examiner

OMNI-DIRECTIONAL ULTRA WIDE BAND MINIATURE DOUBLY CURVED ANTENNA ARRAY

CROSS-REFERENCE TO RELATED APPLICATIONS

The present application incorporates herein by reference U.S. patent application Ser. No. 11/899,920, entitled "WIDE BANDWIDTH BALANCED ANTIPODAL TAPERED SLOT ANTENNA AND ARRAY INCLUDING A MAGNETIC SLOT."

The following United States patent applications are incorporated by reference in their entireties:

| Filing Date | Serial No. |
|---|---|
| Sep. 29, 2010 | 12/893,585 |
| Sep. 29, 2010 | 12/893,648 |

TECHNICAL FIELD

The present disclosure generally relates to the field of antennas, and more particularly to an isotropic antenna providing wide field of view polarization.

BACKGROUND

An antenna may broadly be defined as a transducer for transmitting or receiving energy in the form of electromagnetic waves. An antenna is generally capable of converting the electromagnetic waves into electrical current, or conversely, converting electrical current into electromagnetic waves.

SUMMARY

A device may include a support for supporting a plurality of multi-polarization capable antenna elements. The plurality of antenna elements may include a first antenna element oriented in a first direction, a second antenna element oriented in a second direction, and a third antenna element oriented in a third direction. The support may include a first support portion for supporting the first antenna element, a second support portion for supporting the second antenna element in an arrangement such that the second direction is at least substantially different than the first direction, and a third support portion for supporting the third antenna element in an arrangement such that the third direction is at least substantially different than the first direction and the second direction. The first antenna element supported by the first support portion, the second antenna element supported by the second support portion, and the third antenna element supported by the third support portion generally occupy a volumetric space definable within the bounds of a substantially spherical volume.

A system may include means for supporting a plurality of multi-polarization capable antenna elements within the bounds of a substantially spherical volume. The plurality of antenna elements may include a first antenna element oriented in a first direction, a second antenna element oriented in a second direction, and a third antenna element oriented in a third direction. The second direction may be at least substantially different than the first direction, and the third direction may be at least substantially different than the first direction and the second direction.

A method may include orienting a first multi-polarization capable antenna element within the bounds of a substantially spherical volume in a first direction; determining a second direction at least substantially different than the first direction; orienting a second multi-polarization capable antenna element within the bounds of the substantially spherical volume in the second direction, determining a third direction at least substantially different than the first direction and the second direction; and orienting a third multi-polarization capable antenna element within the bounds of the substantially spherical volume in the third direction.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

A single element antenna may be utilized for radiating and/or receiving polarized electromagnetic radiation. The antenna element may be oriented in a specific direction desirable for transmitting and/or receiving electromagnetic signals having a particular orientation (e.g., with respect to the Earth's surface). In embodiments, a desirable directional orientation for a single antenna element may depend upon the polarization of the antenna and the type of signal being transmitted/received. For example, a dual-polarized antenna may be utilized for radiating and/or receiving circular polarized signals. However, depending on the desired orientation of the signal, a particular directional orientation for the antenna element may be necessary. Thus, single element antennas have nulls and polarization limitations that restrict, for instance, wide Field Of View (FOV) dual orthogonal isotropic polarization radiation. Further, orthogonal polarization on a doubly curved surface (e.g., a spherical surface) may not be compatible with many linearly polarized Ultra Wide Band (UWB) array elements. For example, many types of array elements require placement within a periodic uniform grid for proper performance and maximum bandwidth. However, a uniform periodic rectangular grid may not be mapped to a doubly curved surface without distortions. Additionally, proper control of polarization may require independent polarization control of each antenna element; the elements must be oriented to match a polarization requirement, which is often a different orientation from the periodic lattice that the antenna elements require. Together, the aforementioned limitations have prevented the utilization of many UWB elements in highly curved arrays (e.g., small spheres).

Figure 1:
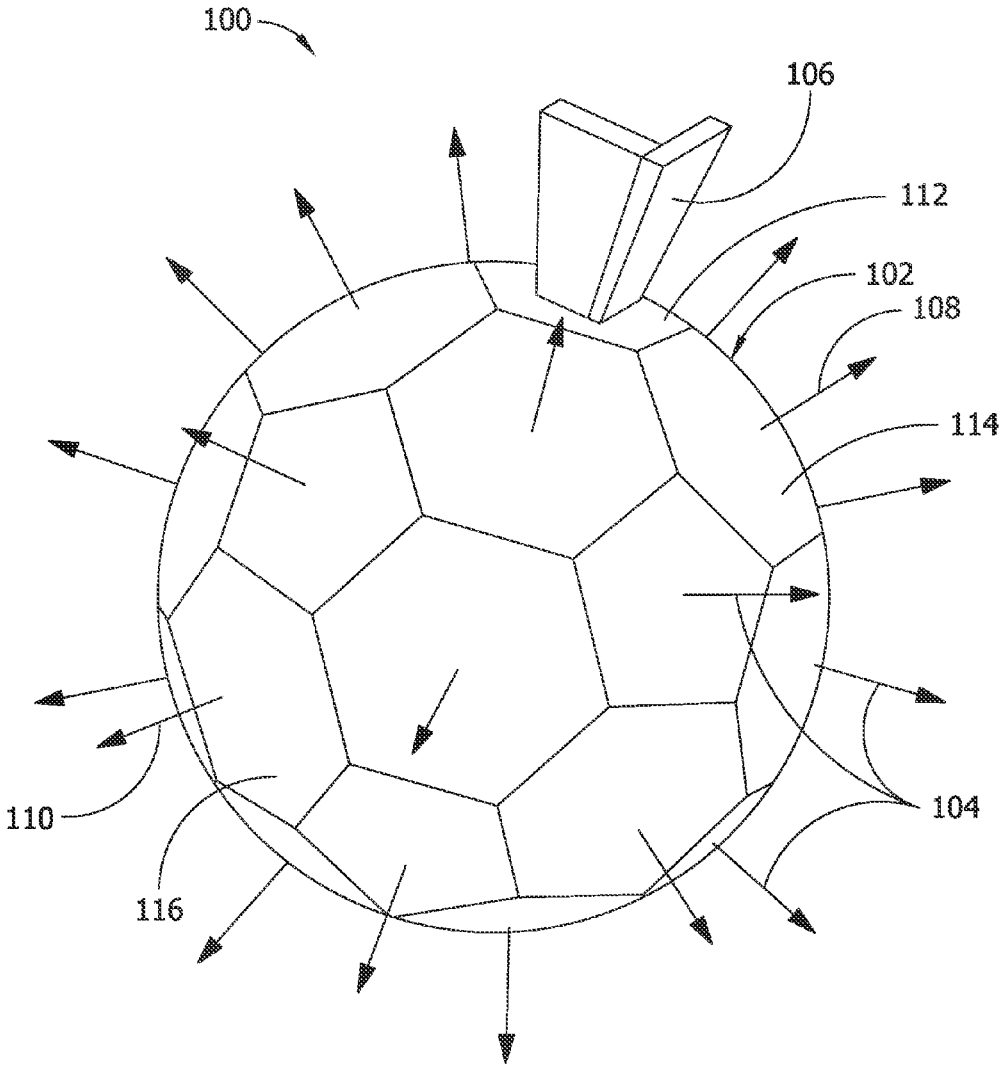
FIG. 1 is a perspective view illustrating a doubly curved antenna array configured as an omni directional-like (isotropic) dual polarization antenna element providing wide field of view dual orthogonal polarization over a substantially spherical volume, where the antenna element is populated with miniature radiating elements to create an electrically small spherical array.

Referring now to FIGS. 1 through 22, an antenna array 100 is described in accordance with the present disclosure. The antenna array 100 may include a support 102 for supporting a plurality of antenna elements 104. In embodiments, the plurality of antenna elements 104 may include a first multi-polarization capable antenna element 106, a second multi-polarization capable antenna element 108, and a third multi-polarization capable antenna element 110. Each multi-polarization capable antenna element may include at least two polarizations (e.g., a dual-polarized antenna element having two orthogonal polarizations, a tri-polarized element, a quad-polarized element, and/or other antenna elements capable of multiple polarizations may be utilized with the present disclosure). Further, the support 102 may include a first support portion 112, a second support portion 114, and a third support portion 116. The first support portion 112 may be utilized for supporting the first antenna element 106. The second support portion 114 may be utilized for supporting the second antenna element 108. And finally, the third support portion 116 may be utilized for supporting the third antenna element 110. While three antenna elements and support portions are described in detail, it will be appreciated that more antenna elements and/or support portions may be utilized in accordance with the present disclosure, as shown in FIG. 1.

In some embodiments, the first support portion 112, the second support portion 114, and the third support portion 116 may be fabricated separately, one from the other. For instance, each support portion may be fabricated to include a separate Integrated Circuit (IC) card including an antenna element, or the like. In an example, multiple radiation elements may be included on a single IC card. The support portions may then be affixed together, such as fastening the support portions together with an adhesive, with mechanical fasteners, or the like. In other embodiments, the support portions may be fabricated separately, but when assembled, the support 102 may be of unitary construction, such as by co-molding the support 102 with the first support portion 112, the second support portion 114, the third support portion 116, and the like. Additionally, the support portions may be separate sections of a single material. For example, the plurality of antenna elements 104 may be co-molded with a support material where the support portions are defined as different regions of a contiguous material. In embodiments, flexible Radio Frequency (RF) printed circuits, and/or Low Temperature Co-fired Ceramic (LTCC) technology, and/or silicon or other types of micromachining subtractive or rapid prototyping additive fabrication processes may be utilized to create three-dimensional dual polarization combiner networks.

In embodiments, the local sub-facet radiating elements may be optimized, independently controlled, and oriented in their local coordinate systems. Thus, the first support portion 112, the second support portion 114, and the third support portion 116 may be arranged such that the second multi-polarization capable antenna element 108 is positioned in at least a substantially different direction from the first multi-polarization capable antenna element 106, and the third multi-polarization capable antenna element 110 is positioned in at least a substantially different direction from both the first antenna element 106 and the second antenna element 108. For example, in one embodiment shown in FIG. 1, the first antenna element 106 is oriented in a first direction, the first direction generally parallel to the orientation of the first antenna element 106. Second antenna element 108 is oriented in a direction indicated by the vector representing the second antenna element 108. Third antenna element 110 is oriented in a direction indicated by the vector representing the third antenna element 110. Thus, in embodiments, the antenna radiating element axis to axis angle may vary. For instance, the angle between antenna elements may vary as dependent on the contour of the antenna structure and the element density on the surface. In this manner, the first antenna element 106, the second antenna element 108, and the third antenna element 110 are all positioned in different directions. Thus, in embodiments, multi-polarization (e.g., dual-polarization or tri-polarization) may be created locally at each faceted surface/geometric subsurface of a doubly curved structure, where all polarizations have the same FOV and propagation direction for sub-surface facet sub sets of the doubly curved surface. Further, the polarization properties of each subsurface may be independently adjusted and optimized such that null free, dual-polarization may be primarily realized for a wide FOV (e.g., up to and including 4-pi steradians) for the aggregate multi-element structure. On an aggregate omni directional dual orthogonal implementation, polarization may be relative as per the Ludwig 3 definition.

For the purposes of the present disclosure, in the accompanying figures the antenna elements are variously illustrated as thin, rectangular prisms and/or as vectors. Any of these various representations should be understood in their appropriate context as graphical representations attempting to convey a directional orientation for the antenna elements. Thus, the figures are not meant to be limiting or overly descriptive of the physical structure of such antennas. Antennas of many varying shapes and sizes may be utilized with the present invention. Further, one vector illustration or the illustration of a single physical structure is not meant to be limiting and may imply multiple individual directional antenna elements, such as two antenna elements forming an array, or a number of antenna elements forming a sub array of antenna elements. In embodiments, the antenna elements are fabricated as dual (or greater than two) polarization stand-alone subassemblies. In embodiments, dual (or greater than two) polarization elements may be attached to flexible/pliable printed feed.

In embodiments, the plurality of antenna elements 104 includes miniature radiating elements, to provide an electrically small spherical array. Pattern synthesis techniques may be utilized to realize omni-directional, dual polarization performance in doubly curved miniature arrays (e.g., a closed sphere in one example). For instance, in one specific embodiment, the array may be the size of a golf ball. One type of antenna element for utilization with the antenna array 100 may include an antenna as disclosed in U.S. patent application Ser. No. 11/899,920, entitled "WIDE BANDWIDTH BALANCED ANTIPODAL TAPERED SLOT ANTENNA AND ARRAY INCLUDING A MAGNETIC SLOT." Other types of antenna elements for utilization with the antenna array 100 may include antennas as disclosed in co-pending U.S. patent application Ser. No. 12/893,585, entitled "ULTRA WIDE BAND BALANCED ANTIPODAL TAPERED SLOT ANTENNA AND ARRAY WITH EDGE TREATMENT;" and Ser. No. 12/893,648, entitled "PHASE CENTER COINCIDENT, DUAL-POLARIZATION BAVA RADIATING ELEMENTS FOR UWB ESA APERTURES". BAVA antenna elements as disclosed in M. W. Elsallal and D. H. Schaubert, "Reduced-Height Array of BAVA with Greater Than Octave Bandwidth," 2005 Antenna Applications Symposium, pp. 226-242, 21-23, September, 2005, may also be utilized with the antenna array 100. These references are herein incorporated by reference in their entirety. Further, it will be appreciated that various other antennas/antenna elements may be utilized with the antenna array 100 without departing from the scope and spirit of the present disclosure.

In embodiments, by capturing three different (and possibly orthogonal) polarizations at each local facet, any dual orthogonal polarization (e.g., Linear, Vertical (V), Horizontal (H), Right Hand Circular Polarized (RHCP), Left Hand Circular Polarized (LHCP), or elliptical) may be post processed for any potential incident angle without introducing poles or nulls that may limit the filed of view of the antenna array 100. In embodiments, the various dual orthogonal polarizations across and wide FOV may be accomplished by changing the magnitude and/or phase of one or more of the first multi-polarization capable antenna element 106, the second multi-polarization capable antenna element 108, and the third multi-polarization capable antenna element 110. Further, by utilizing at least three antenna elements, the antenna elements may be mapped to the surface of the substantially spherical volume 118 in a regular way. In embodiments, the antenna array 100 provides a wide FOV pattern with flat phase and null-free amplitude response over an ultra-wide instantaneous bandwidth (UWB).

Figure 3:
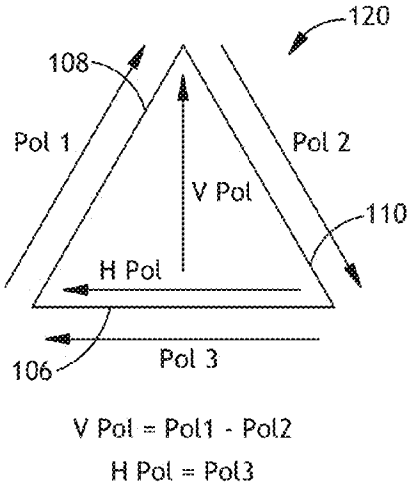
FIG. 3 is a plan view of a triangular unit cell as illustrated in FIG. 2, showing dual and tri-band polarization locally for each facet.
Figure 4:
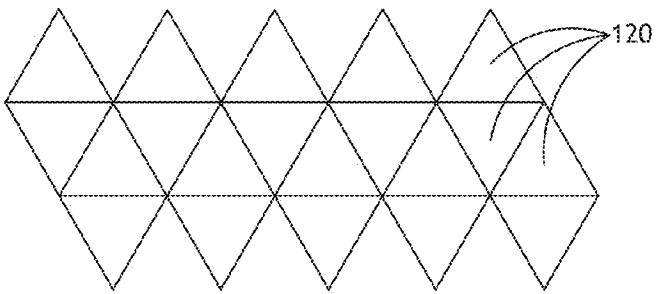
FIG. 4 is a plan view of a multiplicity of triangular unit cells as illustrated in FIG. 2, showing the fully symmetric nature of the tessellated array.
Figure 2:
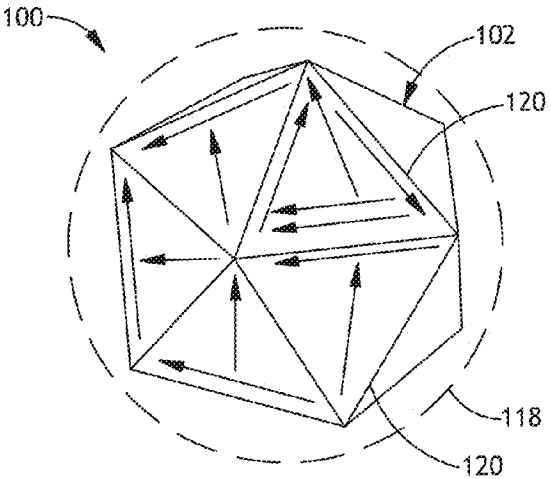
FIG. 2 is a perspective view illustrating an antenna array including regular geometric tessellations over a substantially spherical volume, where the tessellations are in the form of triangular unit cells, and where each triangular surface shows multi-polarization operation.

Referring now to FIGS. 2 through 4, a doubly curved antenna array 100 occupying a substantially spherical volume 118 and having a wide field of view in 4-pi steradians (i.e., all of visible space from the perspective of the antenna array 100) is described in accordance with the present disclosure. The antenna array 100 includes regular geometric tessellations of a sphere to eliminate distortions introduced from a rectangular grid. In embodiments, the antenna array 100 includes a number of triangular unit cells 120. In other embodiments, hexagonal unit cells may be utilized. The triangular unit cells 120 are utilized to tessellate the surface of the doubly curved antenna array 100. As seen in the accompanying figures, the surface of the antenna array 100 may be formed as an icosahedron, allowing the triangular unit cells 120 to uniformly tessellate the generally spherical surface of the antenna array 100 without distortions to its uniform periodic grid. Further, the spherical array may be fully symmetric (as seen in FIG. 4), providing for no local distortions (where every element sees an identical electrical environment) and may be maximally isotropic in phase/gain.

In embodiments, each one of the triangular unit cells 120 is tri-polarized. For instance, each triangular unit cell 120 includes a first tri-polarized antenna element 106, a second tri-polarized antenna element 108, and a third tri-polarized antenna element 110. In this manner, dual orthogonal linear polarization may be implemented across a wide field of view (e.g., across greater than a hemisphere of the generally spherical surface of the antenna array 100). Further, by generating three polarizations at each unit cell, grid periodicity and array performance may be preserved, even with the doubly curved antenna array 100. In embodiments, when the field of view of the antenna is substantially larger than one hemisphere of the doubly curved antenna array 100, three polarizations per unit cell 120 may provide for an optimal implementation of the Ludwig 3 polarization definition. In embodiments, a feed backplane may be constructed from a single folded flexible printed circuit board.

Figure 5:
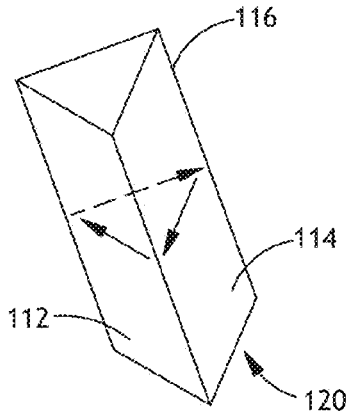
FIG. 5 is a perspective view illustrating another type of triangular unit cell, where the triangular unit cell is constructed in the form of a triangular prism and represents a sub array of antenna elements.
Figure 6:
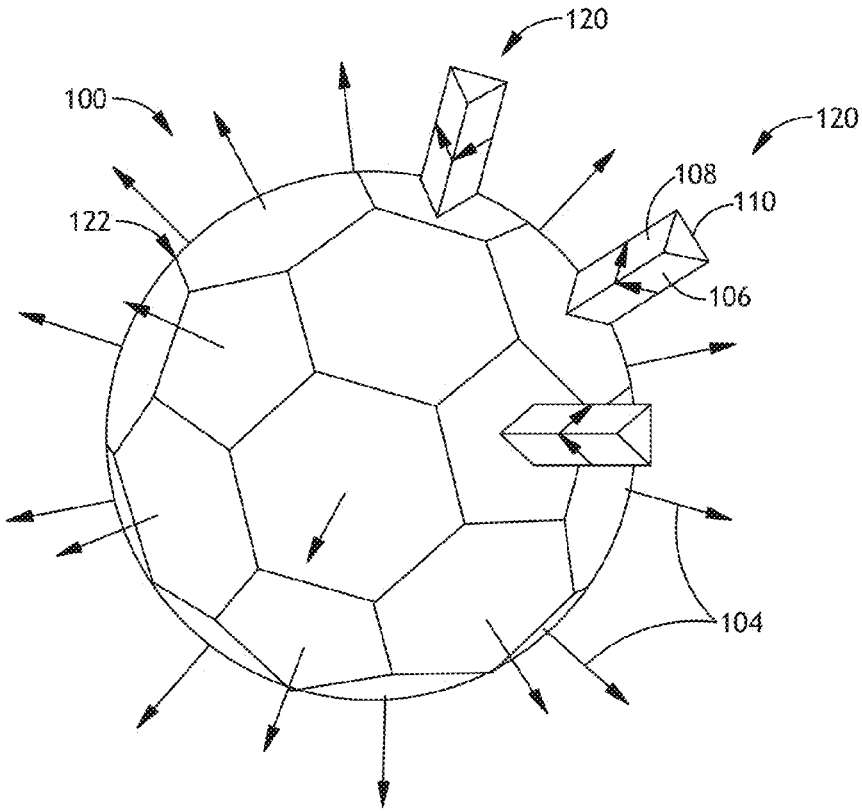
FIG. 6 is a perspective view illustrating a doubly curved antenna array including a support frame for supporting a number of the triangular unit cells illustrated in FIG. 5.

Referring now to FIGS. 5 and 6, it will be appreciated that other shapes and configurations may be utilized with the antenna array 100. For example, the antenna array 100 may include a support frame 122 with several supports 102 including radiating antenna elements 104 standing off one or more faces of the support frame 122. For example, the triangular unit cell 120 illustrated in FIG. 5 may comprise a sub array of elements affixed to a support frame 122 of an antenna array 100, in combination with other sub arrays (as seen in FIG. 6). Further, each one of the plurality of antenna elements 104 may be affixed to a specific location on the tessellated spherical surface and locally rotated to realize true vertical and horizontal linear polarization over a wide FOV (e.g., 4-pi steradians in the limit). Moreover, the entire surface of the support frame 122 may be potted for structural rigidity and/or environmental ruggedness. For example, interior and/or exterior portions of the support frame 122 may be filled with a solid compound for providing resistance to shock and/or vibration. In embodiments, the support frame 122 and internal/external portions thereof may be potted with a thermosetting plastic, or the like.

Figure 7:
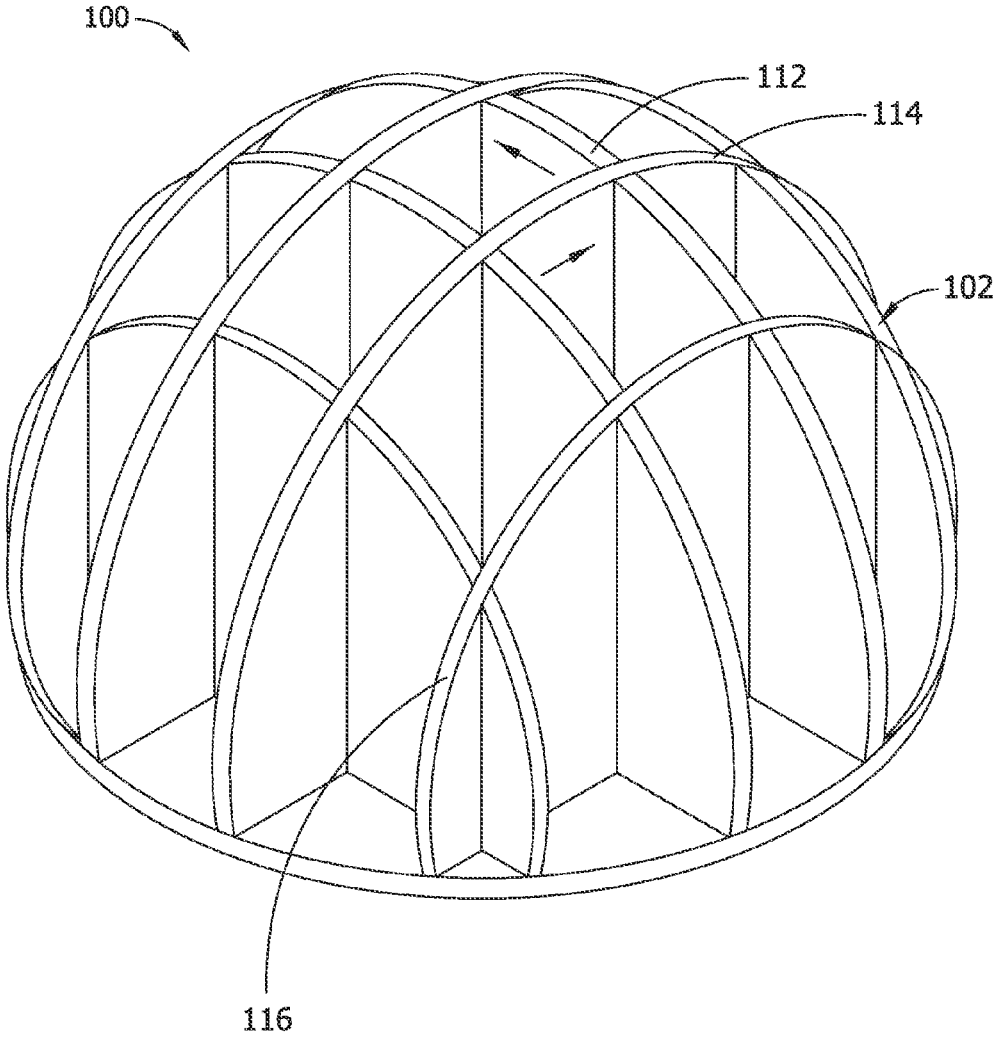
FIG. 7 is a perspective view illustrating a spherical grid embodiment for an antenna array that realizes dual polarization over the majority of a sphere.
Figure 8:
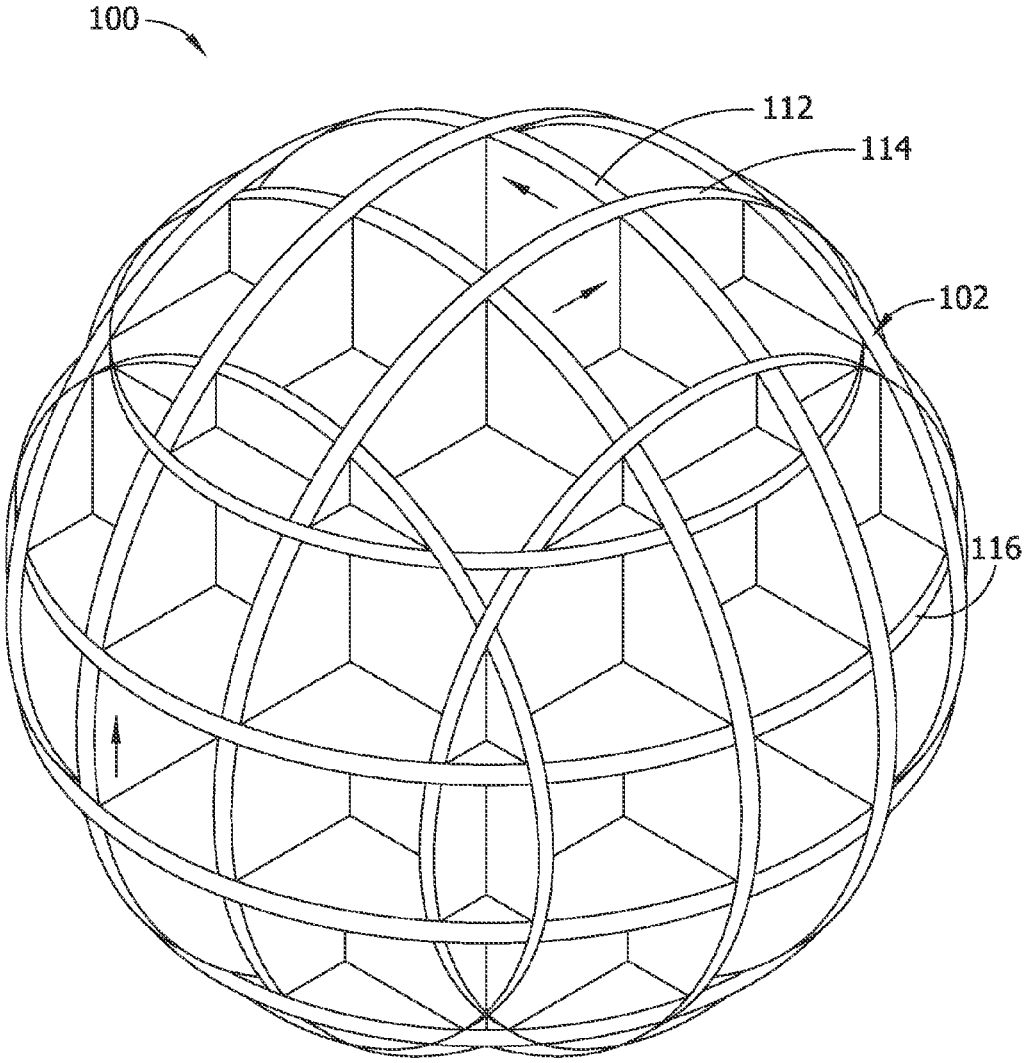
FIG. 8 is a perspective view illustrating a tri-polarization spherical grid embodiment of an antenna array to optimize dual orthogonal polarization over a sphere.
Figure 9:
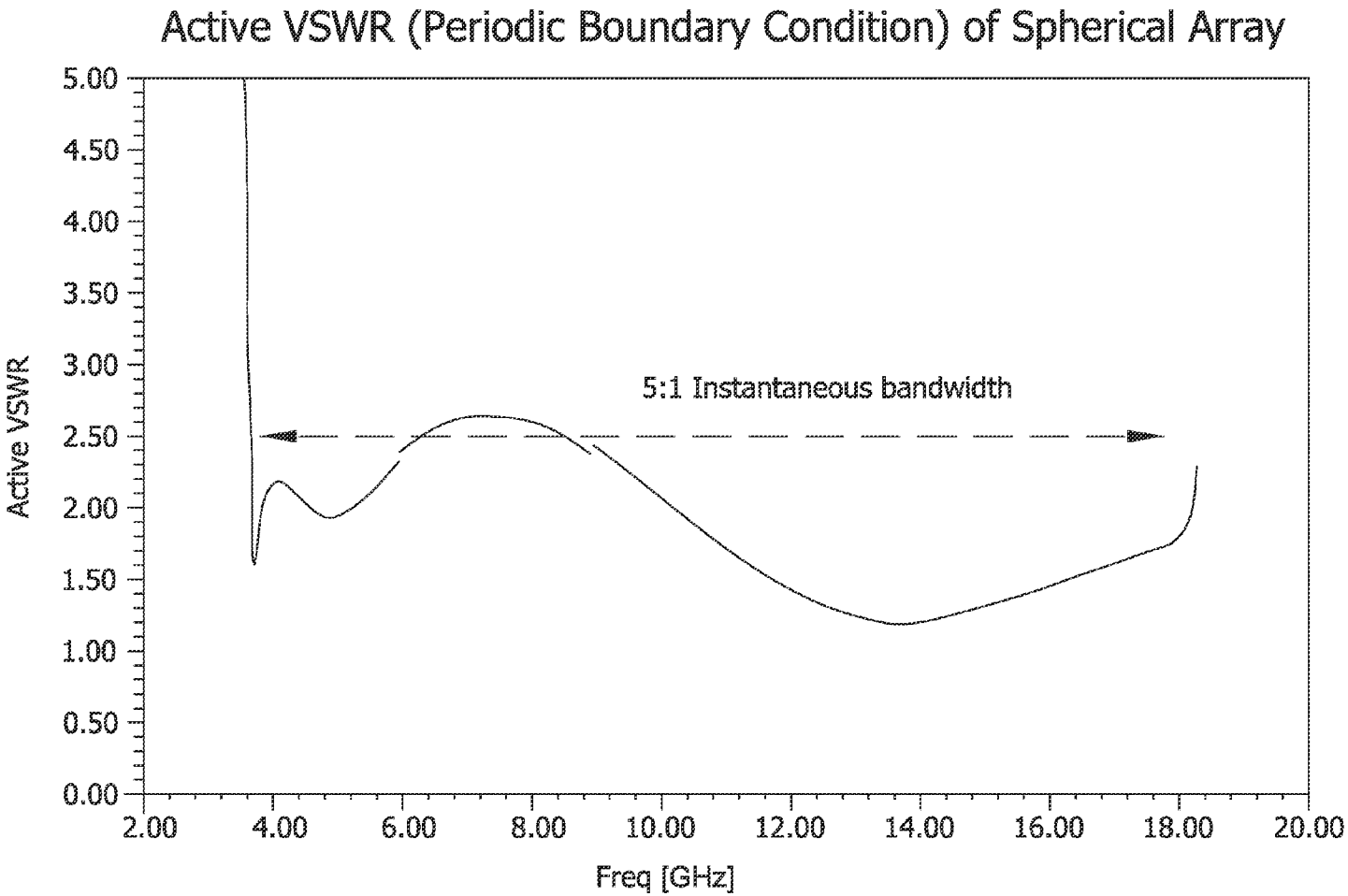
FIG. 9 is a graph illustrating a periodic boundary condition active Voltage Standing Wave Ratio (VSWR) for a spherical array.
Figure 10:
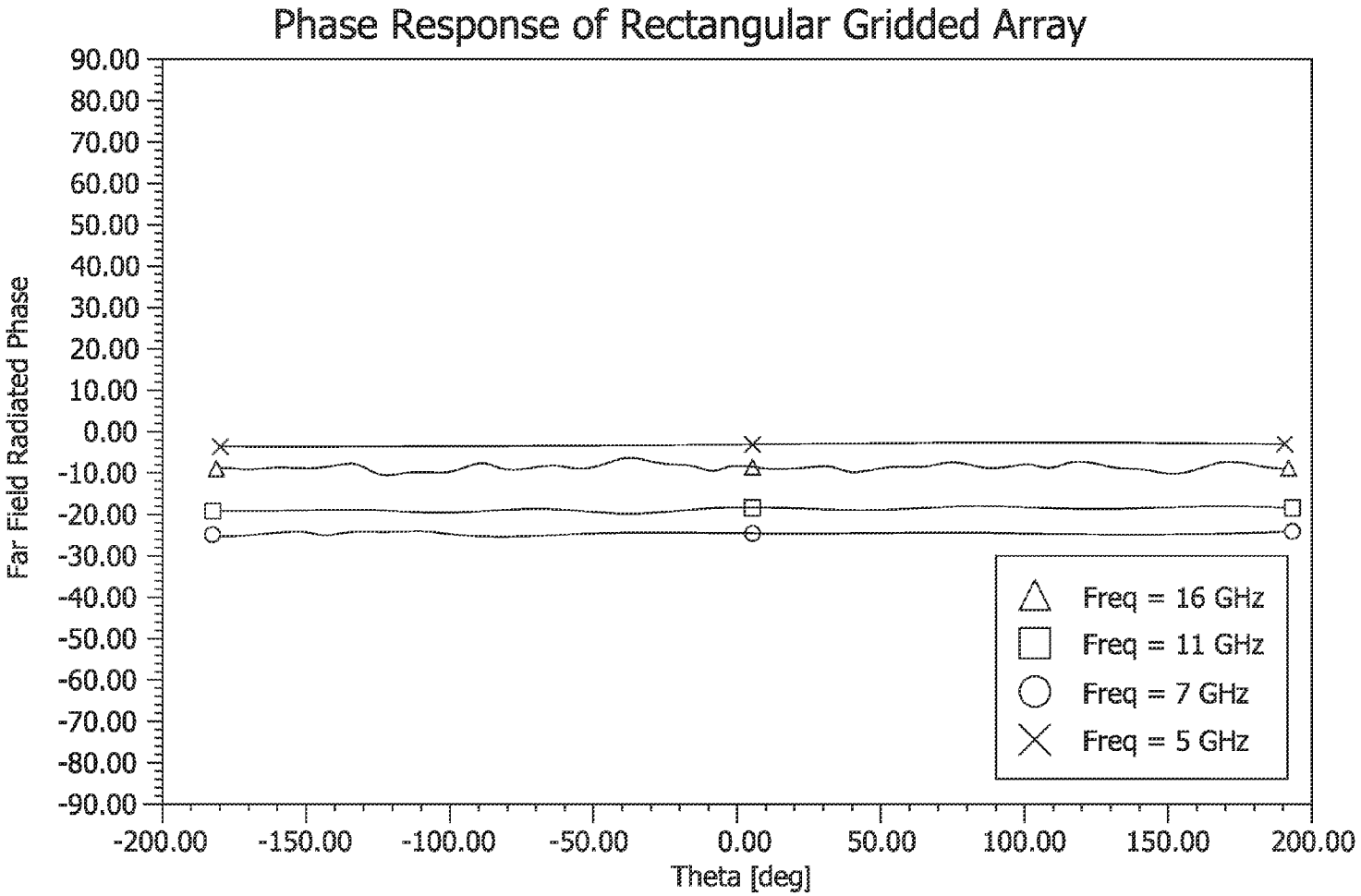
FIG. 10 is a graph illustrating a phase response across the E-field of an electrically small antenna array.

Referring now to FIGS. 7 and 8, a dual polarization spherical grid embodiment of an antenna array 100 (FIG. 7) and a tri-polarization spherical grid embodiment of an antenna array 100 (FIG. 8) are shown. For example, FIG. 7 illustrates dual orthogonal polarization of a substantial portion of spherical radiation space. For the tri-polarization spherical grid embodiment, three polarizations may be utilized to optimize dual orthogonal radiation over 4-pi radiation space utilizing the Ludwig 3 polarization definition to prevent nulls in the radiation pattern. Further, a feed network may combine polarizations locally across the substantially spherical volume to produce a well behaved polarization response. In embodiments, any class of end-firing radiating elements may be utilized with the implementations illustrated in FIGS. 7 and 8, including Transverse Electromagnetic Horn (TEM) radiating elements, and the like.

Figure 11:
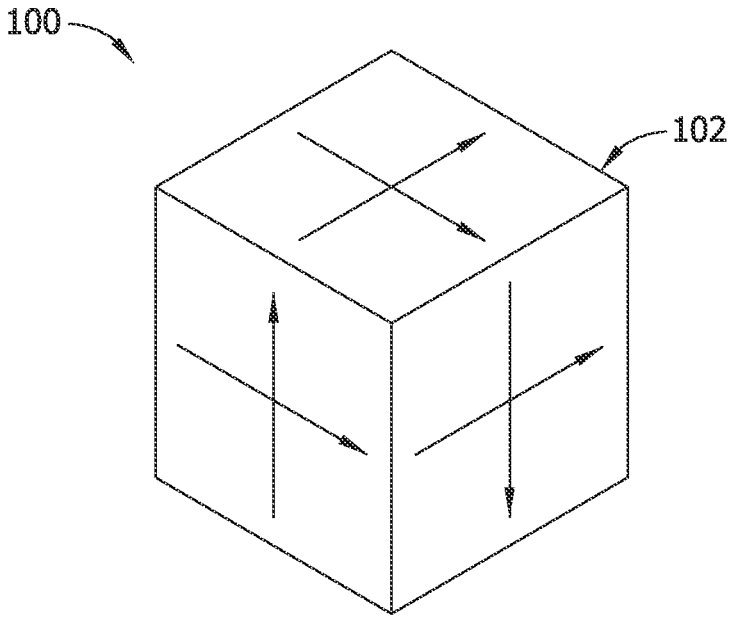
FIG. 11 is a perspective view illustrating a cube-shaped embodiment of a wideband dual polarization antenna array.
Figure 12:
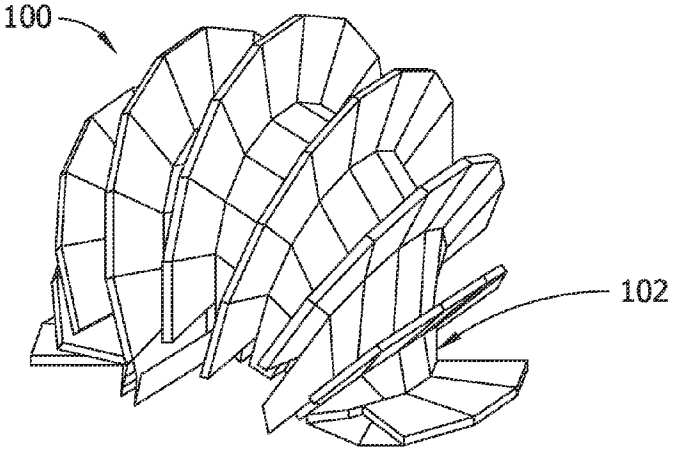
FIGS. 12-14 are schematics illustrating a further doubly curved antenna array configured as an isotropic dual polarization antenna element, where the support structures shown are simplified for the purposes of electromagnetic simulation and would be physically different in an implementation.
Figure 14:
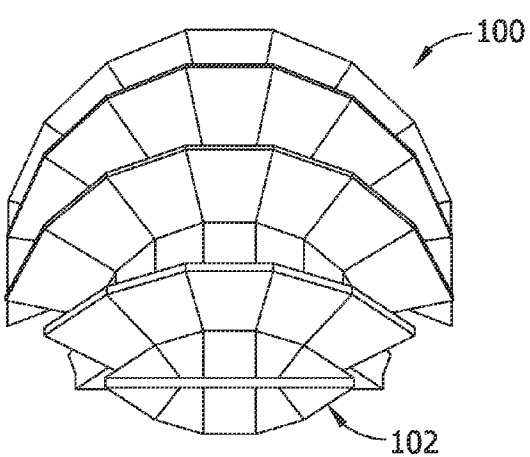
Figure 13:
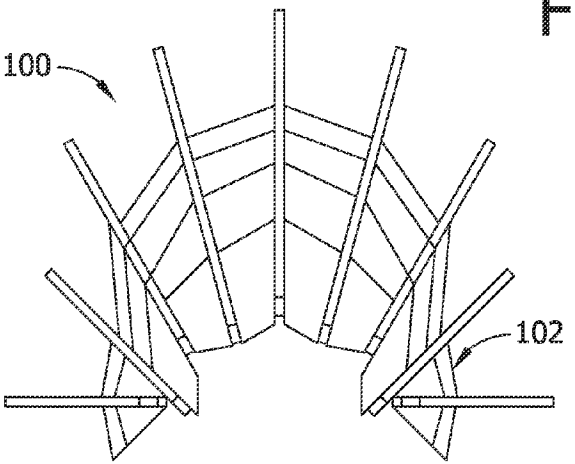
Figure 15:
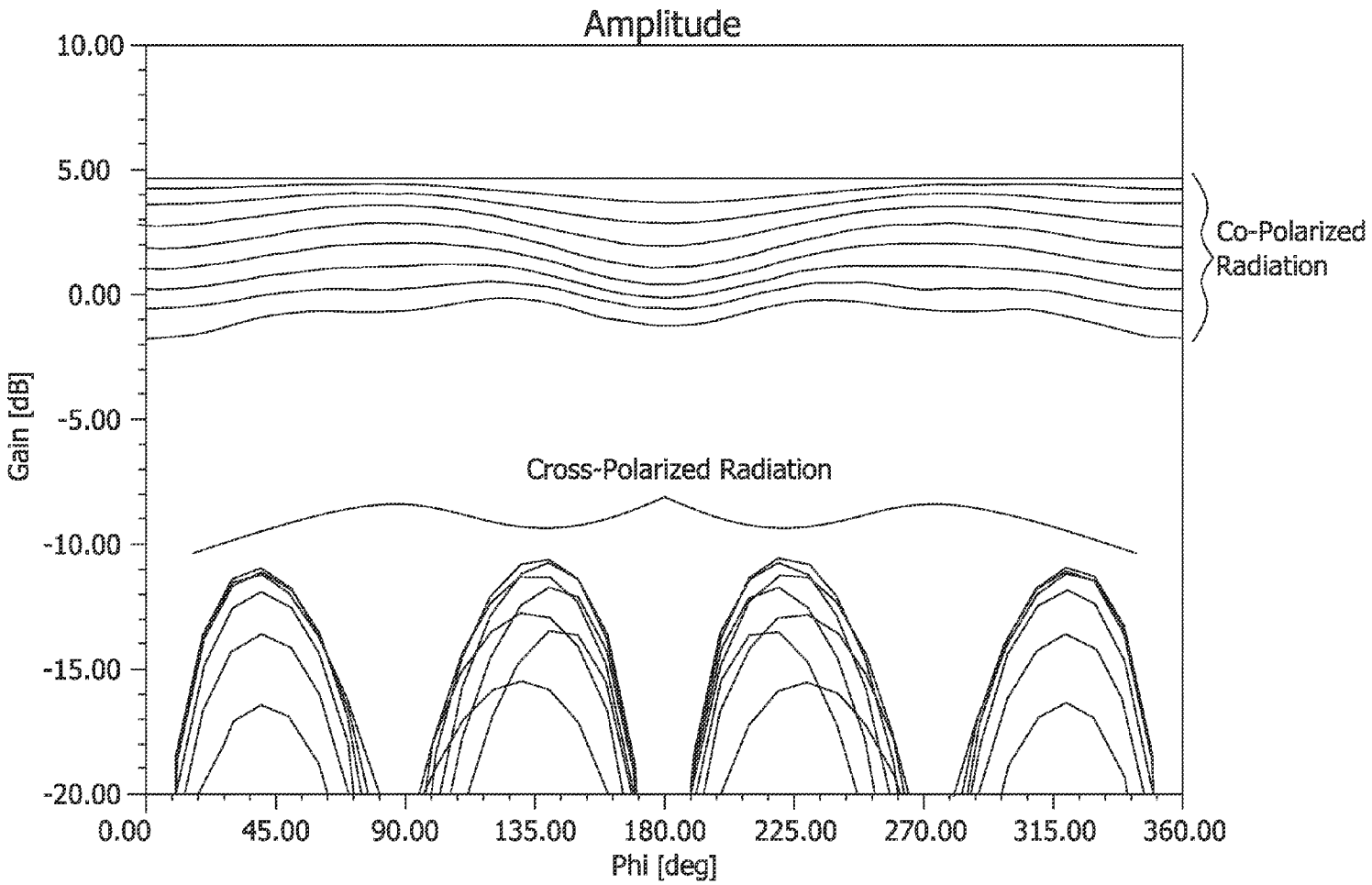
FIG. 15 is a graph illustrating gain in decibels (dB) versus angle for the antenna array illustrated in FIGS. 12-14.
Figure 16:
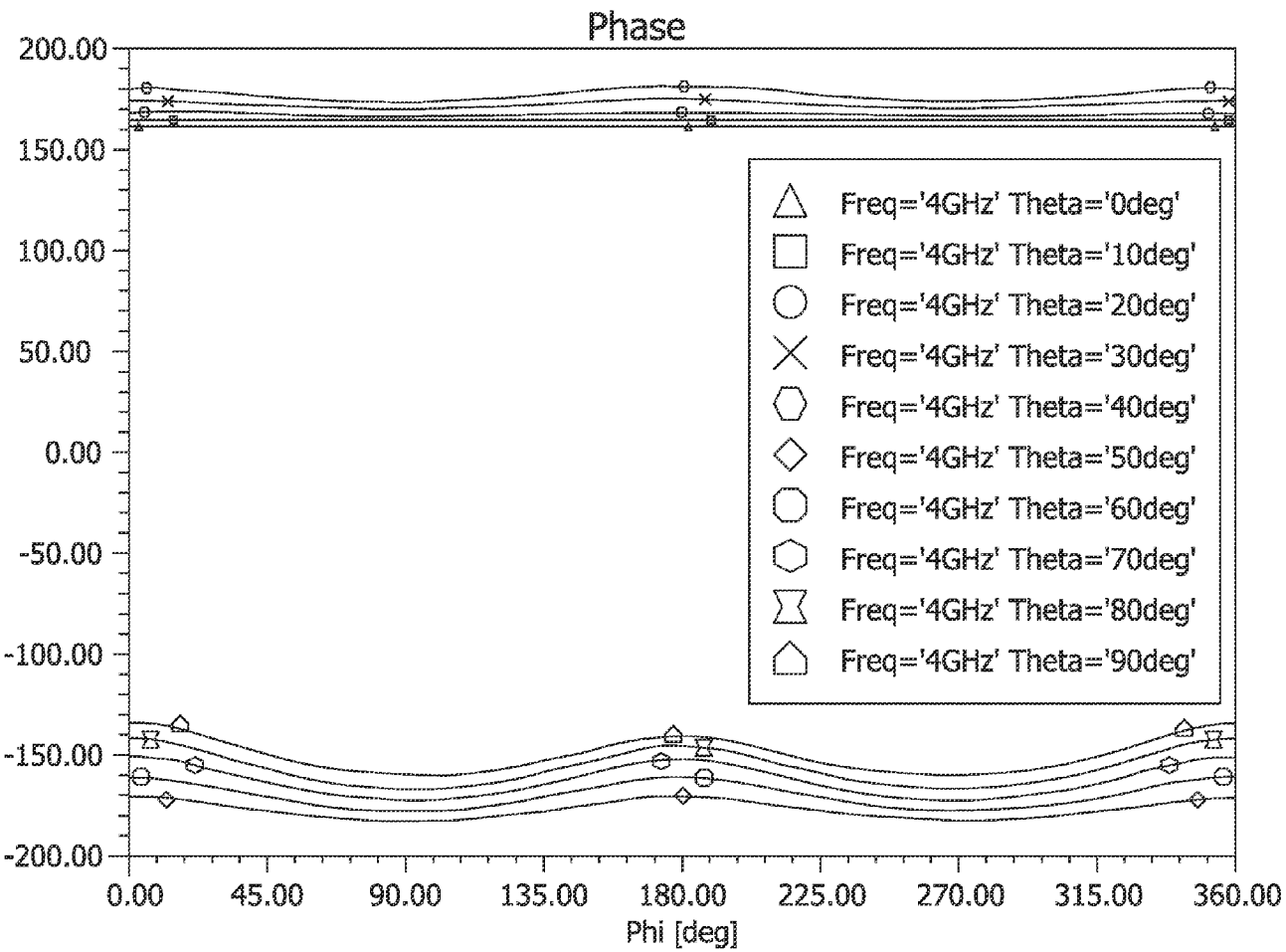
FIG. 16 is a graph illustrating phase versus angle for the antenna array illustrated in FIGS. 12-14.
Figure 17:
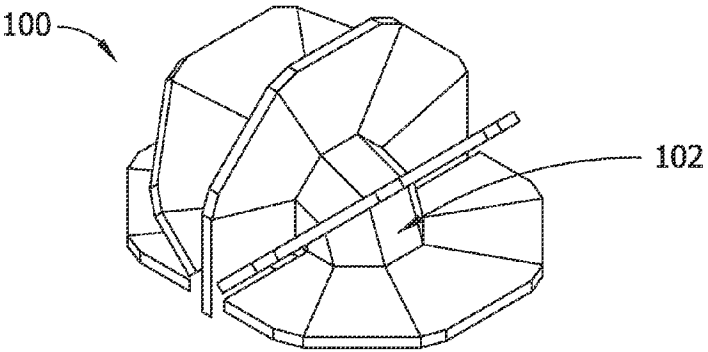
FIGS. 17-19 are perspective views of another doubly curved antenna array configured as an isotropic dual polarization antenna element, where the support structures shown are simplified for the purposes of electromagnetic simulation and would be physically different in an implementation.
Figure 19:
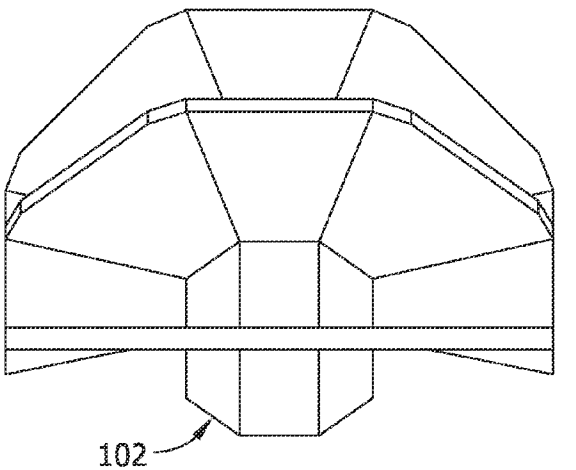
Figure 18:
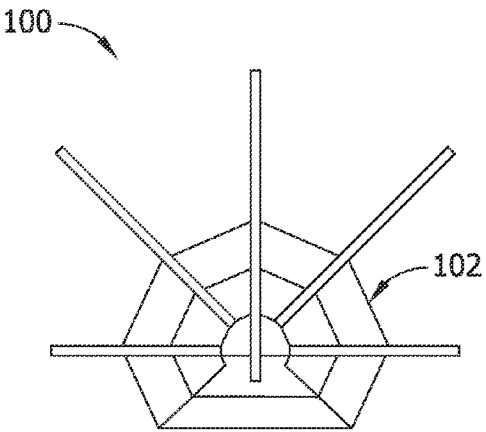
Figure 20:
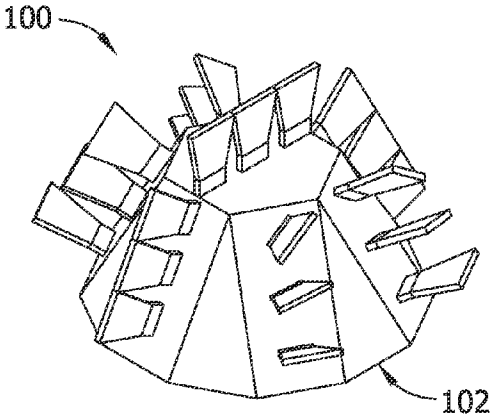
FIGS. 20-22 are perspective views of a still further doubly curved antenna array configured as an isotropic dual polarization antenna element, where the support structures shown are simplified for the purposes of electromagnetic simulation and would be physically different in an implementation.
Figure 21:
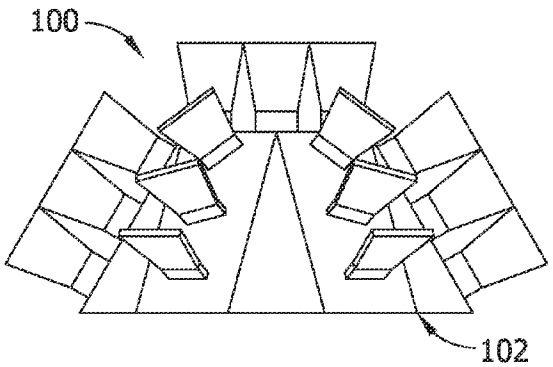
Figure 22:
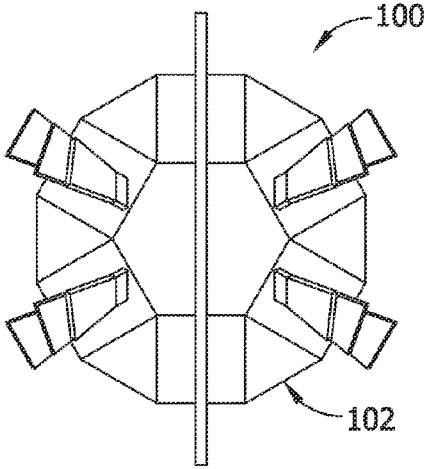

Referring now to FIG. 11, a cube-shaped embodiment of a wideband dual polarization antenna array 100 is described. The antenna array 100 may achieve wideband performance typical of planar patch elements. In one embodiment, five elements may be populated on various faces of the support 102 cube structure. Further, full coverage may be provided in both polarizations over the FOV (i.e., no nulls in either polarization direction). It will be appreciated that other radiating elements, such as BAVA antenna elements (e.g., as disclosed in M. W. Elsallal and D. H. Schaubert, "Reduced-Height Array of BAVA with Greater Than Octave Bandwidth," 2005 Antenna Applications Symposium, pp. 226-242, 21-23, September, 2005) may be utilized in conjunction with the implementation shown in FIG. 11.

For the present disclosure, active circuitry may be utilized in the combining networks to sum the responses of the individual elements on two or more facets of the miniature doubly curved array to optimize radiation performance. RF switches, True Time Delay (TTD) devices, and amplification/attenuator circuits may be dynamically controlled by software, or the like. FIG. 3 illustrates a specific implementation where horizontal polarization (HP) and vertical polarization (VP) may be synthesized through vector summation of the individual polarization elements (Pol1, Po12, and Pol3). In other embodiments, Low Noise Amplifier's (LNA's) may be inserted at the element level to optimize system noise and/or temperature noise. Further, distributed RF power amplification may be utilized by incorporated miniature Power Amplifier's (PA's) at the element level, the sub array level, and/or the full miniature array level. RF miniature Transmitter/Receiver (T/R) modules and/or RFIC based hybrid analog/digital beam forming may also be utilized at the element level, the sub array level, and/or the full miniature array level.

Further, pure digital beam forming techniques may be utilized at the element level, the sub array level, and/or the full miniature array level with ND technology.

In the present disclosure, the methods disclosed may be implemented as sets of instructions or software readable by a device. Further, it is understood that the specific order or hierarchy of steps in the methods disclosed are examples of exemplary approaches. Based upon design preferences, it is understood that the specific order or hierarchy of steps in the method can be rearranged while remaining within the disclosed subject matter. The accompanying method claims present elements of the various steps in a sample order, and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A device, comprising:

a triangular unit cell for supporting a plurality of antenna elements, each antenna element of the plurality of antenna elements configured for multi-polarization, the plurality of antenna elements including a first antenna element oriented in a first direction, a second antenna element oriented in a second direction, and a third antenna element oriented in a third direction;

and the triangular unit cell including a first support portion for supporting the first antenna element, a second support portion for supporting the second antenna element in an arrangement such that the second direction is at least substantially different than the first direction, and a third support portion for supporting the third antenna element in an arrangement such that the third direction is at least substantially different than the first direction and the second direction, the first support portion, second support portion, and third support portion in contact with each other in a triangular configuration;

wherein the triangular unit cell is configured to tessellate on a surface of a spherical support of a doubly curved antenna array.

2. The device of claim 1, wherein the first antenna element has at least one of a dual-polarization or a tri-polarization.

3. The device of claim 1, wherein the spherical support of the doubly curved antenna array includes a doubly curved surface.

4. The device of claim 1, wherein at least the first antenna element and the second antenna element are definable together as a sub array of antenna elements.

5. The device of claim 1, wherein the spherical support of the doubly curved antenna array includes a solid compound configured for providing resistance to at least one of: shock and vibration.

6. The device of claim 1, wherein responses from the first antenna element, the second antenna element, and the third antenna element are combined.

7. A system, comprising:

means for supporting a plurality of antennas within a substantially spherical volume, each antenna of the plurality of antennas including a first antenna element oriented in a first direction;

a second antenna element oriented in a second direction; and a third antenna element oriented in a third direction;

wherein the first antenna element, second antenna element, and third antenna element are configured to form a triangular unit cell, the second direction is at least substantially different than the first direction, and the third direction is at least substantially different than the first direction and the second direction, and wherein each triangular unit cell is configured to tessellate a surface of the means for supporting the plurality of antennas.

8. The system of claim 7, wherein each antenna of the plurality of antennas has at least one of a dual-polarization or a tri-polarization.

9. The system of claim 7, wherein the support means includes a doubly curved surface.

10. The system of claim 7, wherein at least the first antenna element and the second antenna element are definable together as a sub array of antenna elements.

11. The system of claim 7, wherein the means for supporting the plurality of antennas includes a solid compound configured for providing resistance to at least one of: shock and vibration.

12. The system of claim 7, wherein responses from the first antenna element, the second antenna element, and the third antenna element are combined.

13. A method, comprising:

orienting a first antenna within the bounds of a substantially spherical volume in a first direction;

determining a second direction at least substantially different than the first direction;

orienting a second antenna within the bounds of the substantially spherical volume in the second direction, determining a third direction at least substantially different than the first direction and the second direction; and orienting a third antenna within the bounds of the substantially spherical volume in the third direction, configuring the first antenna, second antenna, and third antenna as a triangular unit cell;

tessellating the triangular unit cell on a surface of a spherical support.

14. The method of claim 13, wherein the first antenna, second antenna, and third antenna have at least one of a dual-polarization or a tri-polarization.

15. The method of claim 13, wherein the spherical support includes a doubly curved surface.

16. The method of claim 13, further comprising:

defining at least the first antenna and the second antenna together as a sub array of antenna elements.

17. The method of claim 13, further comprising:

combining responses from the first antenna, the second antenna, and the third antenna.

18. A doubly curved antenna array configured in a icosahedron shape, comprising:

a plurality of triangular unit cells configured to tessellate a surface of the doubly curved antenna array, each triangular unit cell of the plurality of triangular unit cells including:

a first antenna element oriented in a first direction, a second antenna element oriented in a second direction, a third antenna element oriented in a third direction; and an icosahedron shaped support, the icosahedron shaped support configured to support each triangular unit cell;

wherein the triangular unit cells uniformly tessellate the surface of the doubly curved antenna array without distortions to the antenna array periodic grid.

19. The doubly curved antenna array as claimed in claim 18 wherein the doubly curved antenna array is approximately a size of a golf ball.

20. The system of claim 18, wherein each triangular unit cell has at least one of a dual-polarization or a tri-polarization.

* * * * *